US008960505B2

(12) United States Patent
Gertitschke et al.

(10) Patent No.: US 8,960,505 B2
(45) Date of Patent: Feb. 24, 2015

(54) DEVICE FOR THE QUANTITATIVELY REGULATED DELIVERY OF BULK PRODUCT

(71) Applicant: Uhlmann Pac-Systeme GmbH & Co. KG, Laupheim (DE)

(72) Inventors: Detlev Gertitschke, Laupheim (DE); Robert Lehmann, Gundelfingen (DE); Joachim Noe, Ehingen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 1 day.

(21) Appl. No.: 13/895,854

(22) Filed: May 16, 2013

(65) Prior Publication Data

US 2013/0306193 A1 Nov. 21, 2013

(30) Foreign Application Priority Data

May 16, 2012 (EP) ..... 12168197

(51) Int. Cl.

| | |
|---|---|
| ***B67D 3/00*** | (2006.01) |
| ***B65B 1/30*** | (2006.01) |
| ***B65B 35/06*** | (2006.01) |
| B65B 1/06 | (2006.01) |
| ***B65B 5/10*** | (2006.01) |

(52) U.S. Cl.

CPC . *B65B 1/30* (2013.01); *B65B 35/06* (2013.01); *B65B 1/06* (2013.01); *B65B 5/103* (2013.01); *B65B 5/106* (2013.01)

USPC ..... 222/504; 222/333; 222/310; 222/559; 222/409

(58) Field of Classification Search

CPC ..... B65B 35/20

USPC ..... 222/226, 181.1, 559–560, 504, 509, 222/361, 408, 409, 344, 342, 310, 314, 307, 222/306, 290, 333, 319, 59, 528; 53/248; 141/95, 311 R, 331

See application file for complete search history.

(56) References Cited

U.S. PATENT DOCUMENTS

| | | | | |
|---|---|---|---|---|
| 1,777,670 | A * | 10/1930 | Hausman | 222/55 |
| 4,460,110 | A * | 7/1984 | Helander | 222/504 |
| 5,551,210 | A | 9/1996 | Williamson | |
| 5,956,908 | A * | 9/1999 | Bitschnau et al. | 52/197 |
| 6,510,676 | B1 * | 1/2003 | Gauthier | 53/501 |

FOREIGN PATENT DOCUMENTS

| | | | |
|---|---|---|---|
| DE | 10026331 | A1 | 2/2002 |
| WO | WO 2010/053369 | A2 | 5/2010 |

OTHER PUBLICATIONS

European Search Report for priority application EP 12168197.7 dated Sep. 13, 2012.

* cited by examiner

*Primary Examiner* — Kevin P Shaver
*Assistant Examiner* — Robert Nichols, II
(74) *Attorney, Agent, or Firm* — Brinks Gilson & Lione

(57) ABSTRACT

The device for the quantitatively regulated delivery of bulk product includes a supply tank for the bulk product and a slider element, which forms the boundary of an outlet gap on one side. The slider element comprises on its front end an elastic, U-shaped loop, the upper part of which is fixed in position, whereas a rear portion of the lower part of the loop is connected to a linear drive. The linear drive can be used both to adjust the width of the outlet gap by translational movement of the lower section of the loop and to produce a small-amplitude back-and-forth movement of the lower section of the loop. In this way, it is possible to release bulk product of various shapes and sizes reliably and without damage in a quantitatively regulated manner.

18 Claims, 2 Drawing Sheets

DEVICE FOR THE QUANTITATIVELY REGULATED DELIVERY OF BULK PRODUCT

RELATED APPLICATIONS

The present patent document claims the benefit of priority to European Patent Application No. EP 12168197.7, filed May 16, 2012, the entire contents of each of which are incorporated herein by reference.

FIELD AND BACKGROUND OF THE INVENTION

The present invention relates to a device for the quantitatively regulated delivery of bulk product.

In many areas of application, bulk product must be delivered from a supply tank in the most quantitatively regulated way possible.

Devices for the quantitatively regulated delivery of bulk product are known from, for example, DE 92 71 99 A and DE 53 13 29 A. In these devices, the bulk product is stored in a funnel-shaped supply tank and delivered onto a conveyor chute by a delivery device. The delivery device comprises an angle profile. In DE 92 71 99 A the delivery device also comprises a slider element, wherein the orientation of the angle profile and the position of the slider element influence the size of the delivery gap and thus the quantity of bulk product delivered. Nevertheless, the delivery mechanisms described here are inexact in terms of quantity of the bulk product released and thus not suitable for precise metering, nor are they suitable for sensitive products.

In the pharmaceutical industry, special requirements are imposed on the transport of tablets, because the tablets, capsules, or coated pills, which are provided as bulk product, come in different sizes and shapes and must be handled carefully so as not to damage them.

SUMMARY OF THE INVENTION

It is an object of the present invention to provide a device for the quantitatively regulated delivery of bulk product, which makes possible a uniform product flow, is suitable for a large number of different product shapes and product sizes, and simultaneously does no harm to the product.

According to an aspect of the invention, the device for the quantitatively regulated delivery of bulk product comprises a supply tank for the bulk product and a delivery device for delivering the bulk product from the supply tank to a transport device or container, wherein the delivery device defines an outlet gap for the bulk product and comprises a slider element for influencing the quantity of bulk product delivered through the outlet gap. The slider element comprises at its front end an elastic, substantially U-shaped loop, wherein a rear portion of the upper part of the loop is fixed in position, and wherein a rear portion of the lower part of the loop is connected to a linear drive, which is able to adjust the width of the delivery gap by translational movement of the lower part of the loop and to produce a small-amplitude back-and-forth movement of the lower part of the loop.

In this way, products of different sizes and shapes can be delivered reliably, uniformly, and gently to a downstream transport device or to a container. Because of the elasticity of the loop, the various positions to which the loop can be adjusted, and the various types of movement which the loop can execute, a uniform product stream can be achieved over a wide range of different concrete applications.

It is especially preferred for the elastic loop to be made of food-grade rubber, preferably of Vulkollan. This guarantees that the product will be treated gently, whereas at the same time the loop retains a certain stability.

The metering function has proven to be especially effective when the slider element is arranged at an angle of 0°-50°, and preferably of 0°-35°, to the horizontal.

The rear portion of the upper part of the loop is preferably fastened to a slanted first wall of the supply tank. This guarantees continuous transfer between the supply tank and the delivery device.

In an especially preferred embodiment, the outlet gap is bounded on one side by the curved part of the U-shaped loop and on the other side by a boundary wall. Because the boundary wall is usually rigid, effective delivery-regulation can be achieved merely by adjusting the slider element to the correct gap width. In addition to selecting the correct gap width, it is also possible, to ensure an optimal quantitatively regulated release of products, to adjust the stroke and frequency of the back-and-forth movement of the linear drive and thus of the lower part of the loop to suitable values.

For the standard case, it is advantageous for the boundary wall to be substantially vertical.

First choice for the linear drive is an electromagnetic linear motor, because this is continuously variable and in addition to relatively large translational movements it can also execute short, high-frequency reciprocating movements. Many other types of linear drives which can be used according to the invention are also conceivable. For example, several pneumatic cylinders connected one behind the other could also be used as the linear drive.

The supply tank is preferably designed as a funnel, the second side wall of which is shorter than the first side wall, as a result of which a pass-through opening is formed, through which the bulk product passes on its way to the delivery device. Thus a presorting function is achieved, so that only a limited quantity of bulk product rests directly on the upper part of the loop.

The stroke of the linear drive during the small-amplitude back-and-forth movement of the lower part of the loop is preferably in the range of 1-10 mm. The frequency of the linear drive during the small-amplitude back-and-forth movement of the lower part of the loop is in the range of 0.1-5 Hz, and preferably of 0.5-2 Hz.

The width of the outlet gap, the stroke of the linear drive, and its frequency are, of course, substantially dependent on the size and shape of the product. It is therefore advantageous for the device to comprise a controller, which actuates the linear drive.

The device can also comprise a sensor for detecting the quantity of bulk product which has passed through the outlet gap, this sensor being connected to the controller. In this way, it is possible to ensure a uniform product flow by means of a simple automatic control circuit.

BRIEF DESCRIPTION OF THE DRAWINGS

Additional advantages and features of the present invention can be derived from the following description, which refers to the figures.

DETAILED DESCRIPTION OF SPECIFIC EMBODIMENTS

Figure 1:
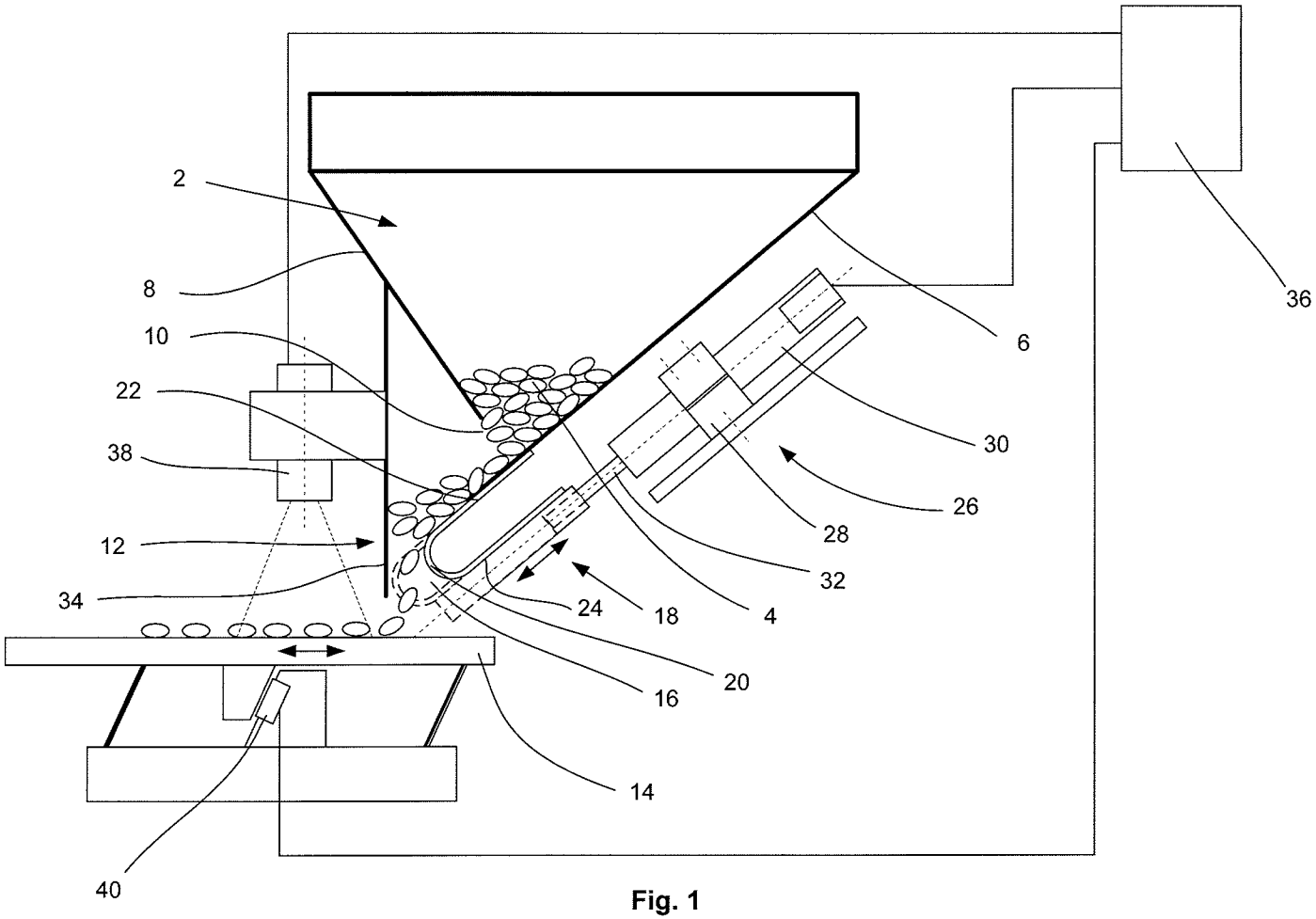
FIG. 1 is a schematic diagram of a first embodiment of the device for the quantitatively regulated delivery of bulk product according to the invention.

The device shown in FIG. 1 for the quantitatively regulated delivery of bulk product comprises a supply tank 2, in which the bulk product 4 is held, which can consist in particular of small pharmaceutical products such as tablets, capsules, coated pills, etc.

In the present example, the supply tank 2 is designed as a funnel. The supply tank 2 comprises two side walls 6, 8, which get closer together as they proceed downward. The first side wall 6 is longer than the second side wall 8, so that a pass-through opening 10 for the bulk product is formed at the bottom end of the second side wall 8. At the same time, the first side wall 6 is preferably extended beyond the pass-through opening 10, so that it forms a projecting web, along which the bulk product 4 slides. In addition to the funnel shape mentioned above, other geometric shapes are also possible for the supply tank 2.

The device for the quantitatively regulated delivery of bulk product also comprises a device 12 for delivering the bulk product 4 from the supply tank 2 to a transport device 14 located underneath, which, in the present case, is a vibrating conveyor. Instead of that, the bulk product 4 could also be delivered directly into a container. The delivery device 12 defines an outlet gap 16 for the bulk product 4. An essential element of the delivery device 12 is a slider element 18, preferably arranged at a predetermined angle to the horizontal, which serves to influence the quantity of bulk product 4 delivered through the outlet gap 16. The slider element 18 is preferably arranged at an angle of 0°-50°, more preferably of 0°-35°, to the horizontal. The angle also preferably corresponds to the orientation of the first side wall 6 of the supply tank 2.

The slider element 18 comprises at its front end an elastic, substantially U-shaped loop 20. The elastic loop 20 is preferably made of food-grade rubber, more preferably of Vulkollan. A rear portion of the upper part 22 of the loop 20 is preferably fastened, possibly screwed, to the extended first side wall 6 of the supply tank 2. It could also be fastened to some other stationary element, such as a bracket in the area of the supply tank 2 or to a similar structure. A rear portion of the lower part 24 of the loop 20 is in turn solidly connected, possibly screwed, to a linear drive 26.

In the example shown here, the linear drive 26 is designed as an electromagnetic linear motor, which is mounted on a bracket 28. The linear motor consists of a stator 30, which is designed as a hollow cylinder and which holds the coil windings. In the stator 30, a rotor 32 is movably supported, the rotor consisting of a tube or a shaft with permanent magnets arranged in a row. By suitably energizing the coils, a controlled force acts on the permanent magnets in the rotor 32, and thus the rotor 32 moves in the stator 30 in infinitely variable fashion. The front end of the rotor 32 is connected to the rear portion of the lower part 24 of the loop 20. Of course, the electromagnetic linear motor could also be designed in some other way.

In the embodiment shown here, the outlet gap 16 is bounded on one side by the curved part of the U-shaped loop 20 and on the other side by a boundary wall 34, which is preferably substantially vertical, but which could also be arranged at a slight angle. Overall, the linear drive 26 is suitable for adjusting the width of the outlet gap 16. The width to which the outlet gap 16 is set varies as a function of the size and shape of the product and the degree to which the delivery device is filled and can be somewhere in the range between 1.2 times and 4 times the product dimensions and thus up to about 50 mm.

When the linear drive 26 moves toward the boundary wall 34, the lower part 24 of the loop 20 also moves in this direction. Because the rear portion of the upper part 22 of the loop 20 is fixed in place and because the loop 20 is made of elastic material, the loop 20 executes a kind of rolling movement, wherein the upper part 22 of the loop 20 becomes longer, and at the same time the curved part of the loop 20 moves closer to the boundary wall 34.

When the linear drive 26 moves back toward the rear, the size of the outlet gap 16 is increased again by the reverse rolling movement of the loop 20.

The linear drive 26 is also designed to bring about a back-and-forth movement of the lower part 24 of the loop 20 at small amplitude and thus also to produce a corresponding pulsating movement in the curved part of the loop 20, as a result of which blockages of the bulk product 4 are loosened up, and the bulk product 4 can maneuver more easily through the outlet gap 16. The stroke and frequency of this small-amplitude back-and-forth movement are again dependent on the size and shape of the product. The stroke is basically preferably in the range of 1-10 mm, whereas the frequency is preferably in a range of 0.1-5 Hz, and more preferably in the range of 0.5-2 Hz. A high-frequency vibratory movement, also produced by the linear drive 26, can also be superimposed on this pulsating movement.

The linear drive 26 is preferably actuated by a controller 36. The controller 36 can in turn use measurement signals from a suitable sensor 38, which detects the quantity of bulk product 4 which has passed through the outlet gap 16. The sensor 38 can, for example, detect the quantity of bulk product 4 present on the transport device 14 and can, for example, be an optical camera, an ultrasound sensor, a capacitive sensor, etc. Ideally, the width of the outlet gap 16 and the stroke and frequency of the back-and-forth movement of the linear drive 26 are adjusted in such a way that a uniform product "carpet", preferably consisting of a single layer, is present on the transport device 14. The controller 36 can also control the operation of an oscillating drive 40 of the transport device 14 to adapt the product flow. Thus the entire filling process can be optimized.

Figure 2:
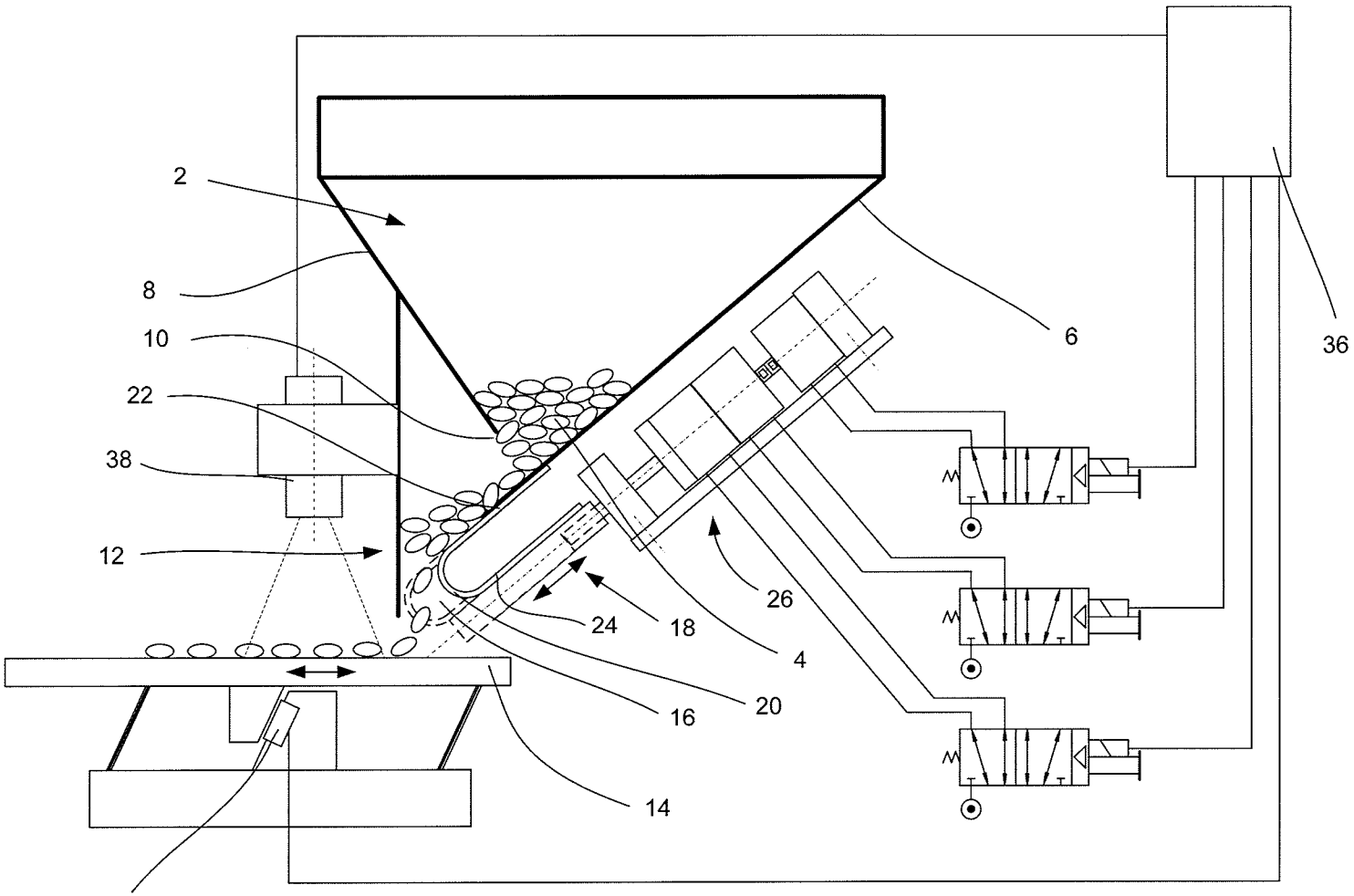
FIG. 2 is a schematic diagram of a second embodiment of the device for the quantitatively regulated delivery of bulk product according to the invention.

The variant shown in FIG. 2 is the same as the embodiment of FIG. 1, except that here several pneumatic cylinders connected one behind the other are used as the linear drive 26. Many other designs for the linear drive 26 are also conceivable.

In the exemplary embodiments shown here, the delivery device 12 has been described as an element separate from the supply tank 2 and arranged in the outlet area of the supply tank. It is also conceivable that the delivery device 12 could form a part of the supply tank 2 and be integrated, for example, into its side walls 6, 8. In this case, the pass-through opening 10 could simultaneously represent the outlet gap 16.

The invention claimed is:

1. A device for the quantitatively regulated delivery of bulk product comprising:

a supply tank for the bulk product;

a delivery device for delivering the bulk product from the supply tank to a transport device or a container, wherein the delivery device defines an outlet gap for the bulk product and comprises a slider element for influencing the quantity of bulk product delivered through the outlet gap;

wherein the slider element comprises at its front end an elastic, substantially U-shaped loop with an upper part, a lower part and a curved part between the upper and lower parts, wherein a rear portion of the upper part of the loop is fixed, and wherein a rear portion of a the lower part of the loop is connected to a linear drive;

wherein the outlet gap is bounded on one side by the curved part of the U-shaped loop and on the other side by a boundary wall;

wherein the linear drive is operable both to adjust a width of the outlet gap by translational movement of the lower part of the loop and to produce a small-amplitude back-and-forth movement of the lower part of the loop;

wherein, when the linear drive moves toward the boundary wall to adjust the width of the outlet gap, the lower part of the loop also moves toward the boundary wall and the loop executes a rolling movement with the upper part of the loop becoming longer, and at the same time the curved part of the loop moves closer to the boundary wall.

2. The device of claim 1 wherein the elastic loop is made of food-grade rubber.

3. The device of claim 1 wherein the slider element is arranged at an angle of 0° -50° to the horizontal.

4. The device of claim 3 wherein the slider element is arranged at an angle of 0° -35° to the horizontal.

5. The device of claim 1 wherein the rear portion of the upper part of the loop is fastened to a slanted first side wall of the supply tank.

6. The device of claim 1 wherein the outlet gap is bounded on a first side by a curved part of the substantially U-shaped loop and on an opposite second side by a boundary wall.

7. The device of claim 6 wherein the boundary wall is substantially vertical.

8. The device of claim 1 wherein the linear drive is an electromagnetic linear motor.

9. The device of claim 1 wherein the supply tank is formed as a funnel having a first side wall and a second side wall, the second side wall being shorter than the first side wall, whereby a pass-through opening is formed, through which the bulk product passes towards the delivery device.

10. The device of claim 1 wherein a stroke of the linear drive during the small-amplitude back-and-forth movement of the lower part of the loop is in the range of 1-10 mm.

11. The device of claim 1 wherein the frequency of the linear drive during the small-amplitude back-and-forth movement of the lower part of the loop is in the range of 0.1-5 Hz.

12. The device of claim 11 wherein the frequency of the linear drive during the small-amplitude back-and-forth movement of the lower part of the loop is in the range of 0.5-2 Hz.

13. The device of claim 1, further comprising a controller which actuates the linear drive.

14. The device of claim 13, further comprising a sensor for detecting a quantity of bulk material which has passed through the outlet gap, the sensor being connected to the controller.

15. The device of claim 1 wherein the rear portion of the lower part of the loop is directly connected to the linear drive.

16. The device of claim 1 wherein the upper part of the loop maintains its planar orientation when the linear drive moves toward the boundary wall to adiust the width of the outlet qap.

17. The device of claim 1 wherein, when the linear drive moves toward the boundary wall to adiust the width of the outlet qap, the lower part of the loop follows a linear path parallel to an axis of the linear drive.

18. The device of claim 1 wherein, when the linear drive moves toward the boundary wall to adiust the width of the outlet qap, the upper part of the loop becomes longer in a direction towards the boundary wall.

* * * * *

UNITED STATES PATENT AND TRADEMARK OFFICE

CERTIFICATE OF CORRECTION

PATENT NO. : 8,960,505 B2
APPLICATION NO. : 13/895854
DATED : February 24, 2015
INVENTOR(S) : Detlev Gertitschke et al.

It is certified that error appears in the above-identified patent and that said Letters Patent is hereby corrected as shown below:

In the Claims

In column 5, claim 3, line 22, replace "0° -50°" with --0°-50°--.

In column 5, claim 4, line 24, replace "0° -35°" with --0°-35$^0$--.

In column 6, claim 16, line 25, after "boundary wall to" replace "adiust the width of the outlet qap." with --adjust the width of the outlet gap.--.

In column 6, claim 17, line 27, after "boundary wall to" replace "adiust" with --adjust--.

In column 6, claim 17, line 28, before "the lower part of" replace "qap," with --gap,--.

In column 6, claim 18, line 31, after "boundary wall to" replace "adiust" with --adjust--.

In column 6, claim 18, line 32, before "the upper part of" replace "qap," with --gap,--.

Signed and Sealed this
Thirtieth Day of June, 2015

Michelle K. Lee

Michelle K. Lee
*Director of the United States Patent and Trademark Office*